United States Patent [19]

Ivarsson

[11] 4,039,150

[45] Aug. 2, 1977

[54] APPARATUS FOR HANDLING WASTE PRODUCTS

[75] Inventor: Torsten Ivarsson, Oskarshamn, Sweden

[73] Assignee: Investmentbolaget Elajo AB, Oskarshamn, Sweden

[21] Appl. No.: 674,420

[22] Filed: Apr. 7, 1976

[30] Foreign Application Priority Data

Apr. 10, 1975 Sweden ..... 7504115

[51] Int. Cl.[2] ..... B02C 13/06; B02C 13/286

[52] U.S. Cl. ..... 241/154; 241/186.4; 241/190; 241/191

[58] Field of Search ..... 241/154, 160, 186 R, 241/186.4, 189 R, 189 A, 190, 191

[56] References Cited

U.S. PATENT DOCUMENTS

| | | | |
|---|---|---|---|
| 2,752,969 | 7/1956 | Gronberg | 241/154 X |
| 3,117,735 | 1/1964 | Fourey | 241/154 X |
| 3,224,688 | 12/1965 | Beiter | 241/189 R X |
| 3,489,078 | 1/1970 | Oberhellmann | 241/186.4 X |
| 3,587,687 | 6/1971 | Hill | 241/154 |
| 3,595,290 | 7/1971 | Tassev | 241/186 R X |
| 3,696,817 | 10/1972 | Bonner et al. | 241/154 X |

FOREIGN PATENT DOCUMENTS

| | | | |
|---|---|---|---|
| 892,938 | 4/1962 | United Kingdom | 241/154 |

*Primary Examiner*—Roy Lake
*Assistant Examiner*—Howard N. Goldberg

[57] ABSTRACT

An improvement in an apparatus for processing waste products, the improvement making it possible effectively to process cardboard or wooden boxes. The apparatus comprises comminuting means including a motor-driven drum having essentially radially projecting teeth arranged on said drum and an anvil for cooperation with said teeth for comminuting the waste products. In addition hereto, the apparatus comprises a downwardly sloping supply duct for the waste products opening in the housing above the drum, and feeding means arranged at the discharge end of the supply duct, said feeding means being rotated. The improvement of the apparatus is that carrier means comprising pins or pegs are disposed on said feeding means and project radially outwards. Preferably, the feeding means consists of a U-shaped clamp, the portion bridging the legs of the clamp being spaced from and extending in parallel to the axis of rotation of said feeding means, said carrier means being disposed on said portion and projecting radially outwards.

5 Claims, 4 Drawing Figures

APPARATUS FOR HANDLING WASTE PRODUCTS

The present invention relates to an improved construction of an apparatus for handling waste products, said apparatus having a comminuting means in a housing, said comminuting means consisting of a motor-driven drum having essentially radially extending knives cooperating with an anvil for comminuting the waste products, said apparatus further having a downwardly sloping supply duct of rectangular cross section positioned above the drum and having its opening in said housing.

An apparatus of this kind is capable of comminuting, disintegrating, deforming and compressing all kinds of ordinary, non-compact waste. Non-compressible or non-deformable waste products, such as telephone directories, discarded machine parts, blocks of wood, metal or concrete, can pass automatically through the apparatus without being comminuted. When handling waste products consisting of wrapping materials of cardboard or wood in such apparatus difficulties will arise in many cases, since the knives have difficulties in effectively catching such materials so as to work and comminute them into such a shape that they can be mixed and compacted with the rest of the waste products. The object of the present invention is to eliminate this drawback.

For this purpose the apparatus according to the invention is provided with a feeding means which is rotatably disposed at the discharging end of the duct on an essentially horizontal shaft extending perpendicularly to the longitudinal axis of the duct, said feeding means being rotated and having essentially the same width as the duct and being provided with carrier means in the form of pins or pegs, said feeding means being disposed in such a manner that the path of movement of the carrier means partly passes over the downwardly sloping bottom of the duct in order to bring the waste products of cardboard or wood into contact with the knives and pre-comminute these products by interaction between the oppositely rotating carrier means and the knives. Thus, cardboard or wood materials pierced by the carrier means will be carried to the comminuting knives and will be held while they are being comminuted and shredded by the rotating knives, whereupon these materials will be continuously mixed with the other comminuted waste products and be ground together with these products into a compact mass.

The feeding means and the drum are preferably adapted to rotate at different speeds of rotation, preferably in the ratio 1:2.

The feeding means is preferably formed as a U-shaped clamp, the legs of which are rotatably mounted on said shaft at their ends facing the open part of the clamp in such a way that the portion bridging the legs of the clamp extends in parallel to said shaft, said carrier means being disposed on said portion and extending radially outwards. This shape of the feeding means provides a structure operating as a winged wheel, continuously feeding glass, metal and plastic containers, etc. from the supply duct to the gap between the comminuting drum and the anvil provided beside the drum, while the waste products in the form of cardboard or wooden boxes are pressed down against the bottom of the channel and are pierced by the carrier means and are thus separated from the rest of the waste products in such a way that the pierced waste products are caught by the comminuting knives.

The carrier pins or pegs preferably have rectangular cross section, thereby stabilizing the adhesion of the cardboard or wood materials to the carrier pins during the movement towards the comminuting knives and during the pre-comminuting process.

In order to facilitate the catching of the cardboard or wood materials, the bottom of the duct may be reinforced at the discharge end by a plate. This plate constitutes an anvil for the waste products which are engaged by the carrier means, said plate further constituting a steady support for the cardboard and wood materials when these materials are pierced by the carrier means. The plate may be provided at its end adjacent the housing with a downwardly resilient portion facilitating the passage of large and bulky cardboard and wood materials being conveyed by the carrier means. The resiliency is easily achieved by said portion of the plate being supported by spring blades secured to the underside of the plate.

Further details of the invention appear from the following description with reference to the accompanying drawings, where two embodiments of the apparatus are shown by way of example.

Figure 1:
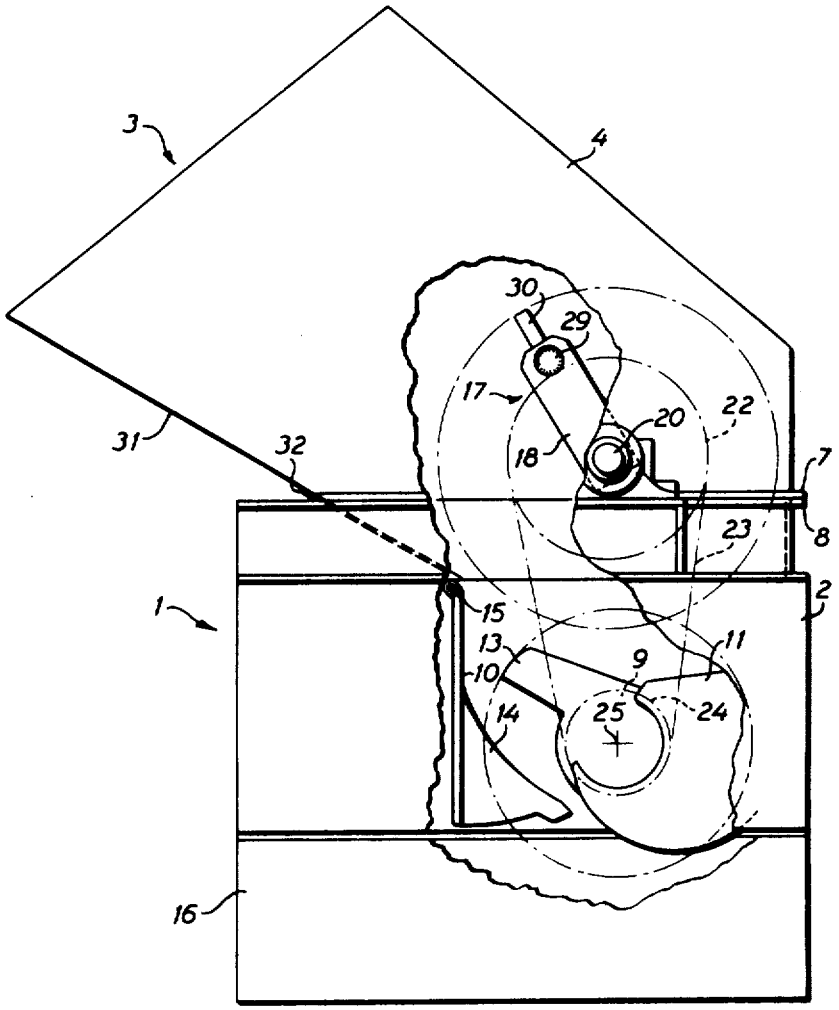
FIG. 1 is a side view of the apparatus having part of the walls of the housing and the supply duct cut away.

The apparatus consists of a lower portion 1 having a housing 2 in which the comminuting means of the apparatus and the driving mechanism for the comminuting means are built in, and an upper portion 3 consisting of a duct 4 for supplying waste products to the comminuting means. The duct 4 is embodied as a downwardly sloping funnel having rectangular cross section and being connected to an opening in the upper wall of the housing 2. The duct 4 is attached at its lower end to a frame 8 of the housing 2 by means of a flange 7.

The comminuting means consist of a comminuting drum 9, an anvil 10 and cleansing means 11. The comminuting drum 9 is rotated by a motor (not shown) and is provided with a row of projecting teeth 13, and the anvil is provided with a row of anvil members 14 between which the teeth move during the rotation of the drum. The waste is ground and comminuted between the teeth of the comminuting drum 9 and the anvil members 14 of the anvil when the drum is rotating. The cleansing means 11 keeps the comminuting drum 9 free from objects that could obstruct the function of the drum and controls the direction of the pressure applied to the waste products to be processed in the apparatus. The anvil 10 is pivotable about an axis 15 such that it can be pivoted at about 45° away from the comminuting drum 9. Normally, the anvil 10 assumes the position shown in FIG. 1, but under certain circumstances when non-compressible objects are received in the apparatus, the anvil is pivoted in a counter-clockwise direction (as seen in FIG. 1). The waste products comminuted between the drum 9 and the anvil 10 fall down into a collecting vessel 16. This comminution is brought about by means of the teeth 13 projecting from the comminuting drum 9 and rotating between the anvil members 14 of the anvil 10 and which greatly comminute the waste products entering between the teeth and the anvil members. As shown in FIG. 1, the drum 9 and the anvil 10 are positioned in relation to each other such that there is a gap between the drum and the anvil. The teeth 13 of the drum 9 are shaped in such a way that they make it possible for glass and metal containers and other objects to be drawn into and caught by this gap, which results in the glass being crushed and the metal containers being disintegrated or greatly deformed. Non-compressible and non-deformable objects, such as concrete blocks, bulky telephone directories, discarded machine parts or the like, the volume of which cannot be reduced, will pass automatically through the apparatus without being comminuted. When such objects are received in the gap, the anvil 10 is pivoted away from the comminuting drum 1 for a short while, so that this object can pass directly down into the vessel 16.

The details of the comminuting means described above are previously known with respect to their construction and function and have been described for the purpose of elucidation of the embodiments of the apparatus shown in the drawings. The improvement of the apparatus, which makes it possible to handle waste products of cardboard and wood materials more effectively and which is mentioned in the preamble, will be described in the following.

In the drawings, reference numeral 17 indicates a feeding means in the form of a U-shaped clamp (FIG. 2), the legs 18 of which are provided with coaxially positioned shaft spindles 19, 20, which protrude through the side walls of the duct 4 and which are mounted in bearings at bearing housings 21 in the frame 8. The left-hand shaft spindle 19 (FIG. 2) is extended beyond its bearing housing 21 and carries a sprocket 22 which is united by means of a chain 23 with a sprocket 24 mounted on the drive shaft 25 of the comminuting drum 9 (not shown in FIG. 2) the size of the sprocket 24 being half the size of the sprocket 22. Beyond the sprocket 22, the shaft spindle 19 is mounted in bearings in an additional bearing housing 26 on a girder 27. Reference numeral 28 in FIG. 2 refers to a protecting cover for the shaft spindle 19, its bearing housings 21 and 26, and the sprocket 22.

Figure 2:
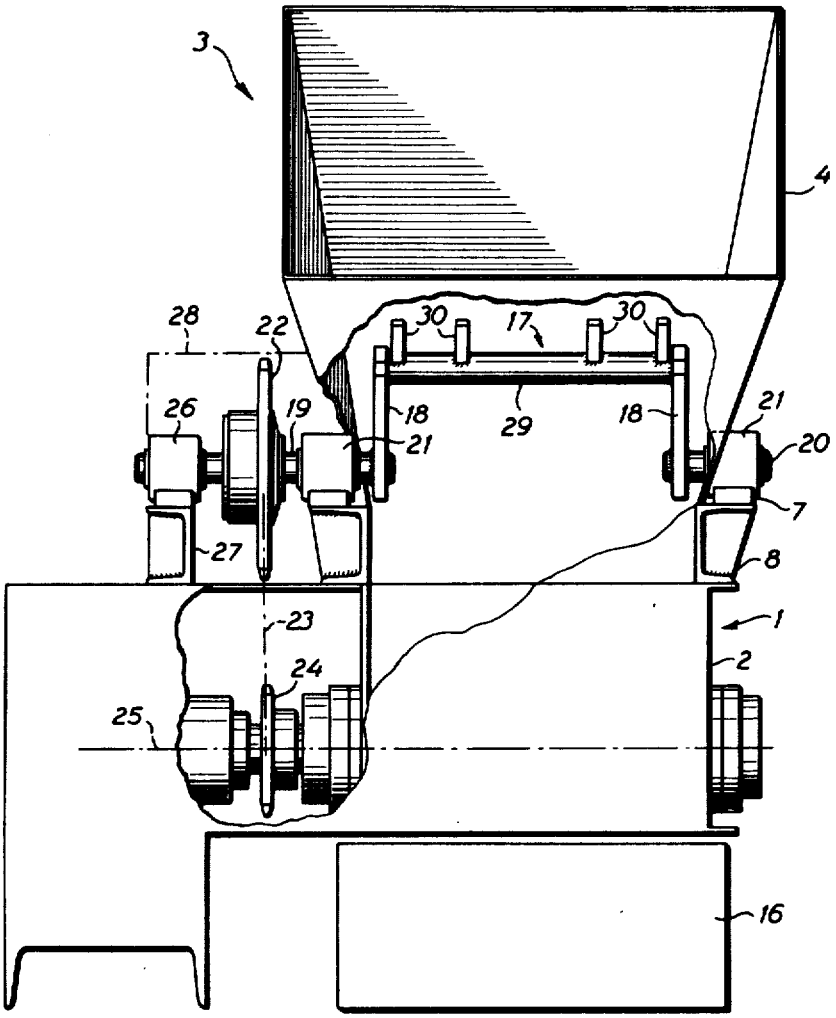
FIG. 2 shows the apparatus according to FIG. 1 as seen from the left and having part of the end walls of the housing and the duct cut away.
Figure 3:
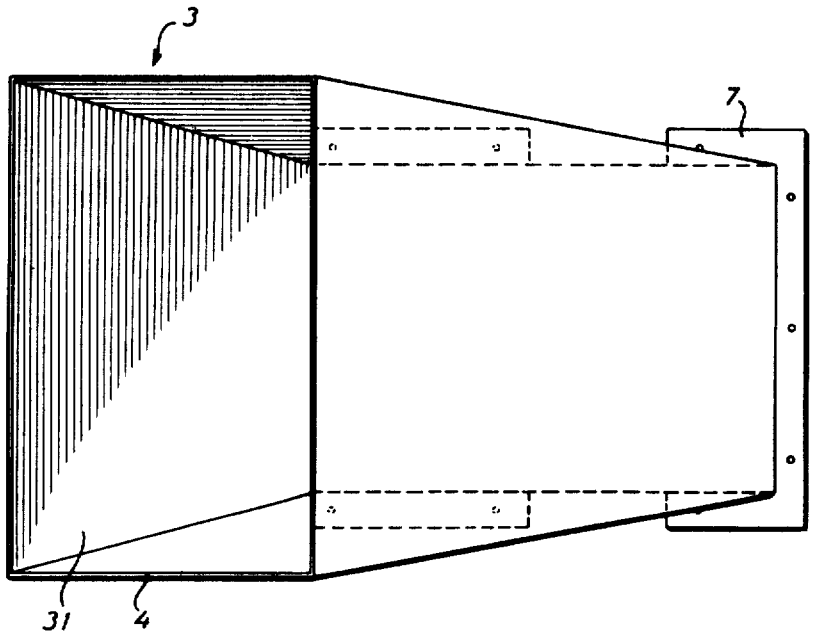
FIG. 3 is a diagrammatic view of the duct seen from above.

To the middle portion 29 of the U-shaped feeding means four radially projecting carrier pins or pegs 30 are welded, said pins moving between adjacent teeth 13 of the comminuting drum 1 when the feeding means is rotating. The carrier pins or pegs 30 have a rectangular cross section (FIG. 2). The downwardly sloping lower wall 31 of the duct 4 is reinforced at the end adjacent the comminuting means by a plate 32, the lower edge of which is positioned adjacent the upper edge of the anvil 10 and adjacent the pivot shaft 15. As appears from FIG. 1, the feeding means is disposed in such a way that its path of movement partly passes over the lower wall 31 of the duct 4 and over the reinforcing plate 32, respectively.

The waste products fed into the duct 4 are carried by the rotating feeding means down into the gap between the comminuting drum 9 and the anvil 10 where the products are comminuted and disintegrated, whereupon they fall down into the vessel 16. The most resistant parts of the waste products press the anvil 10 aside, whereupon they fall directly down into the vessel 16. The cardboard and wood materials among the waste products are pierced against the plate 32 by the carrier pins or pegs 30 in such a way that they are conveyed by these pins or pegs and are clamped against the teeth 13 of the oppositely rotating comminuting drum 9, whereupon they are held by the carrier means while the teeth prepare the comminuting operation by shredding and pre-disintegrating the cardboard and wood materials, the resulting products being mixed with the other waste products, whereupon they fall down into the vessel 16.

Figure 4:
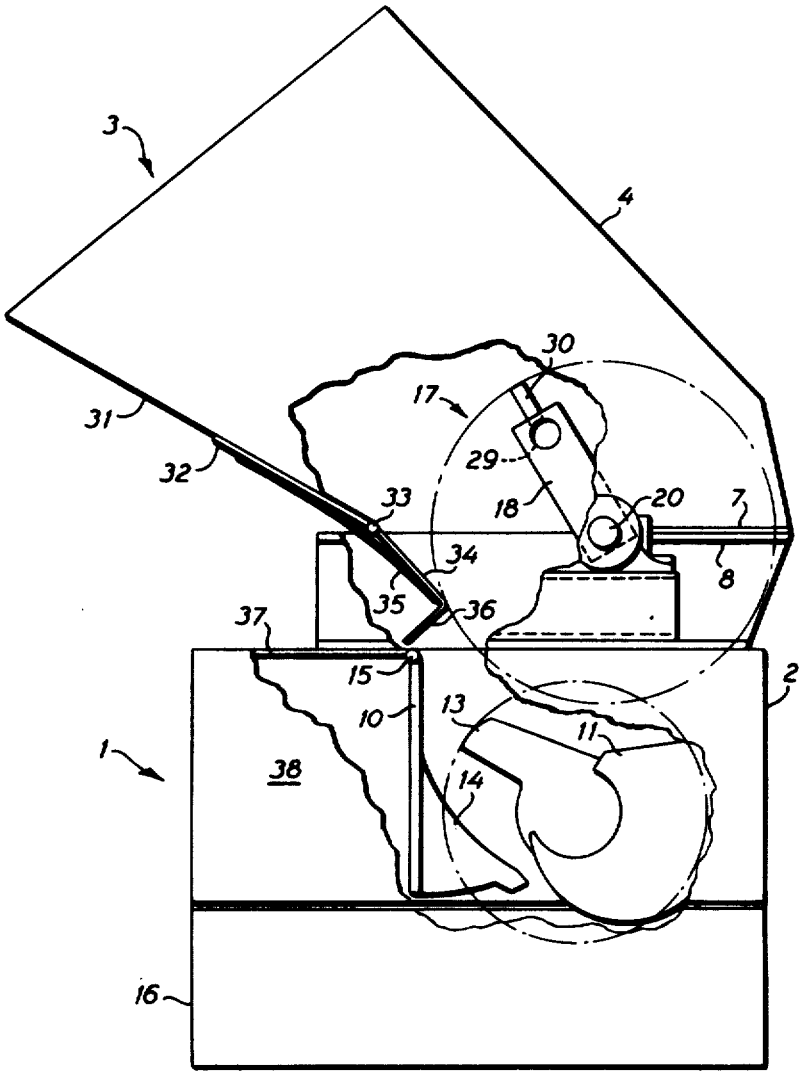
FIG. 4 shows a somewhat modified embodiment of the apparatus according to FIG. 1.

In the embodiment according to FIG. 4 the plate 32 is provided at its end adjacent the comminuting means with a resilient portion 34 mounted on a horizontal pivot 33, said portion being supported by spring blades 35 provided on the underside of the plate. The resilient portion 34 is provided at its lower end with a right-angled flange 36 which slides on and is supported by a horizontal plate 37 when said portion 34 pivots downwards due to the pressure of the waste products passing, said plate constituting the upper wall of the room 38 which is closed by the anvil 10 and positioned beside the drum 9.

The feeding means can be connected to means (not shown) for monitoring a predetermined overload, which means will reverse or alternatively stop the rotation of the feeding means as well as the comminuting drum at an excessive resistance. The feeding means and the comminuting drum may also be provided with individual means for monitoring a predetermined overload and for reversing the rotation of the feeding means and the comminuting drum, respectively.

What I claim is:

1. An apparatus for processing waste products, comprising comminuting means built into a housing, said comminuting means comprising a motor-driven drum having essentially radially projecting teeth arranged on said drum and an anvil for cooperation with said teeth for comminuting the waste products;

a downwardly sloping supply duct for the waste products opening in the housing above the drum;

feeding means rotatably arranged at the discharge end of the duct on an essentially horizontal shaft extending perpendicularly to the longitudinal axis of said duct, said feeding means having essentially the same width as the discharge end of the duct, said feeding means consisting of an essentially U-shaped clamp the legs of which are rotatably arranged of said shaft in such a way that the portion bridging the legs of the clamp extends in parallel to said shaft;

means for rotation of said feeding means; and carrier means comprising pins or pegs being disposed on said portion of said feeding means and projecting radially outwards.

2. An apparatus as claimed in claim 1, wherein said pins or pegs have rectangular cross section.

3. An apparatus as claimed in claim 1, wherein said feeding means and said drum are adapted to rotate at different speeds of rotation, preferably in the ratio 1:2.

4. An apparatus as claimed in claim 1, wherein said carrier means pass over the downwardly sloping bottom of the duct, press down and pierce the waste products and feed them between said teeth in order to disintegrate the waste products by interaction with the teeth.

5. An apparatus as claimed in claim 1, wherein said waste products include boxes made from at least one of the materials of the group consisting of cardboard and wood.

* * * * *